US006557188B1

(12) United States Patent
Peterson

(10) Patent No.: US 6,557,188 B1
(45) Date of Patent: May 6, 2003

(54) BED TO WHEELCHAIR TRANSFER ASSIST DEVICE

(76) Inventor: Kennith L. Peterson, 4168 Rainwood Ave., Yorba Linda, CA (US) 92886

( * ) Notice: Subject to any disclaimer, the term of this patent is extended or adjusted under 35 U.S.C. 154(b) by 0 days.

(21) Appl. No.: 10/100,645

(22) Filed: Mar. 19, 2002

(51) Int. Cl.[7] ..... A61G 7/053
(52) U.S. Cl. ..... 5/81.1 R; 5/662; 135/66
(58) Field of Search ..... 135/66; 5/81.1 R, 5/503.1, 662

(56) References Cited

U.S. PATENT DOCUMENTS

| | | | | | |
|---|---|---|---|---|---|
| 2,981,959 | A | * | 5/1961 | Burnham | 5/503.1 |
| 3,553,746 | A | * | 1/1971 | Seiger | 5/503.1 |
| 5,337,430 | A | * | 8/1994 | Schlein | 5/662 |
| 5,384,927 | A | * | 1/1995 | Mardero et al. | 5/662 |
| 6,012,182 | A | * | 1/2000 | Allen et al. | 5/81.1 R |
| 6,213,435 | B1 | * | 4/2001 | Minet | 248/125.8 |
| 6,240,583 | B1 | * | 6/2001 | Brooke et al. | 5/662 |
| 6,311,942 | B1 | * | 11/2001 | Rotter et al. | 248/316.5 |

* cited by examiner

*Primary Examiner*—Michael F. Trettel
(74) *Attorney, Agent, or Firm*—Morland C. Fischer

(57) ABSTRACT

A bed to wheelchair transfer assist device to be mounted to a bed frame to aid either a disabled individual in transferring himself from a seated position on a bed into a wheelchair or a pain suffering individual when raising and lowering his upper torso between prone and seated positions. When the individual wishes to transfer into the wheelchair or raise or lower his torso, he inserts a removable swan shaped handle of the device into a base. Once inserted in the base, the handle lends a firm support which allows the individual to either push himself off the bed or raise and lower his torso, as required. After the individual has repositioned his body, the handle is removed from the base and placed at an out of site location near the bed. The assist device includes a U-shaped clamping member that is coupled to the base and easily hooked over the existing rail of the bed frame. The position of the clamping member relative to the base can be selectively adjusted depending upon the height of the bed frame rail off the floor.

8 Claims, 5 Drawing Sheets

BED TO WHEELCHAIR TRANSFER ASSIST DEVICE

BACKGROUND OF THE INVENTION

1. Field of the Invention.

This invention generally relates to a hand-rest type device for providing postural support to assist disabled individuals (e.g. quadriplegics) in transferring themselves between a bed and a wheelchair. More particularly, the device is adapted to be mounted on the side rail of a bed frame for assisting a disabled person in getting out of bed without requiring the assistance of another individual.

2. Background Art.

Many individuals do not have the physical strength to transfer from a sitting position on the side of a bed to a wheelchair. Therefore, they require some assistance in transferring safely from the bed to the wheelchair. Examples of the many people who sometimes require assistance in getting into and out of bed are back pain sufferers who frequently experience excruciating pain, especially when lowering their upper torso the last eight or nine inches into bed or raising their upper body the first eight or nine inches when lifting out of bed. Experience has shown that the pain persists regardless of whether the attempt is made while the individual is lying on his side, back or stomach. Other people who may require such assistance are the physically disabled (e.g. quadriplegics).

Current methods for assisting an individual in transferring from a seated position on the side of his bed to a wheelchair subject the individual to falling and possible injury. Some individuals are confined to a wheelchair due to brain strokes which often result in either right or left-side paralysis or weakness. The process of making the bed to wheelchair transfer is taught by rehabilitation specialists with or without the use of a transfer or slider board. Using the transfer or slider board by a weak-sided person is difficult because it must be used on the weak or paralyzed side. Without the transfer or slider board, the individual is trained to push his body up from the bed mattress by pressing down on the mattress using his functioning hand and twisting his crouching torso into the wheelchair.

Thus, a need has existed for a low-cost, easy to use support device for assisting an individual with back pain to get into and out of bed. A common solution which sometimes helps to ease the pain is to keep a quadruped cane at the bedside that, because of its broad base, provides a relatively stable structure which the patient can grasp onto for support so as to be able to pull his upper torso up or down while getting out of or into bed. However, because the lower end of the quadruped cane is not firmly anchored, its stability and, therefore, its effectiveness as a postural support device is limited. Since most people experience medical or non-medical aging problems only periodically and, therefore, do not require assistance at all times, the conventional quadruped cane offers the advantage that it can be easily stowed away when it is not needed and returned to the bedside when support assistance is necessary. This flexibility is of importance to older people, most of whom aspire to live as independently as possible in their own homes, who may be embarrassed by otherwise having to constantly park an assistance device in plain view alongside their bed with the consequence of revealing their infirmity to visitors.

A device which performs a function similar to that provided by a cane is manufactured by Arco Products of Winnipeg, Manitoba, Canada and marketed under the trademark ARCORAIL. This device consists of a cane, one end of which rests upon the floor and is attached to the side rail of an angle iron bed frame for vertical support. The cane is secured to the bed by a clamping system which includes a bar that extends across the bed and is clamped at opposite ends thereof to the opposing side rails. The length of the cross bar is adjustable to accommodate use of the device on single, double or larger size beds. The cane is telescopic for convenient height adjustment.

While the Arco Products device would appear to provide the desired assistance, it has the serious disadvantage that once it is installed on the bed, it is plainly visible. Thus, this device may cause embarrassment to the individual for the same reasons as those discussed above. Moreover, this laterally extending device may actually interfere with the individual's ability to rise from the bed during times when outside assistance is no longer needed. What is even more, the means for attaching this device to and across a bed is relatively cumbersome and heavy, weighting approximately eleven pounds, and therefore costly to manufacture and difficult to transport.

Accordingly, what is still needed is a low cost, light weight and sturdy device to be attached to the existing side rail of a conventional bed to assist an individual in transferring from the bed to a wheelchair. Such a device must be capable of assisting an individual while he is lying down or rising up form the bed. Similarly, the device must be adapted to be easily attached to the bed and stowed out of sight of others when not in use while, at the same time, allowing unencumbered access to the bed.

Another example of a transfer assist device is available by referring to U.S. Pat, No. 5,337,430 issued Aug. 16, 1994.

SUMMARY OF THE INVENTION

A primary objective of the present invention is to provide a transfer assist device to enable either a disabled individual to safely and easily transfer from a sitting position on the side of a bed to a wheelchair or a pain suffering individual to raise and lower his upper torso between prone and seated positions on the bed. The height of the transfer assist device is adjustable above the floor so as to be reliably, quickly and easily attached to the existing metal bed rail. By grabbing onto a removable handle of the device, the individual will be able to push his body off the mattress and toward the wheelchair. Once partially in the wheelchair, the device is used to stabilize the individual's body and assist him in sliding back into the seat of the wheelchair. The handle of the device can be easily removed by the individual and moved to a nearby but out of sight location to facilitate his return from the wheelchair to the bed without revealing the individual's infirmity or blocking the individual's legs from swinging onto the bed.

DETAILED DESCRIPTION

Figure 1:
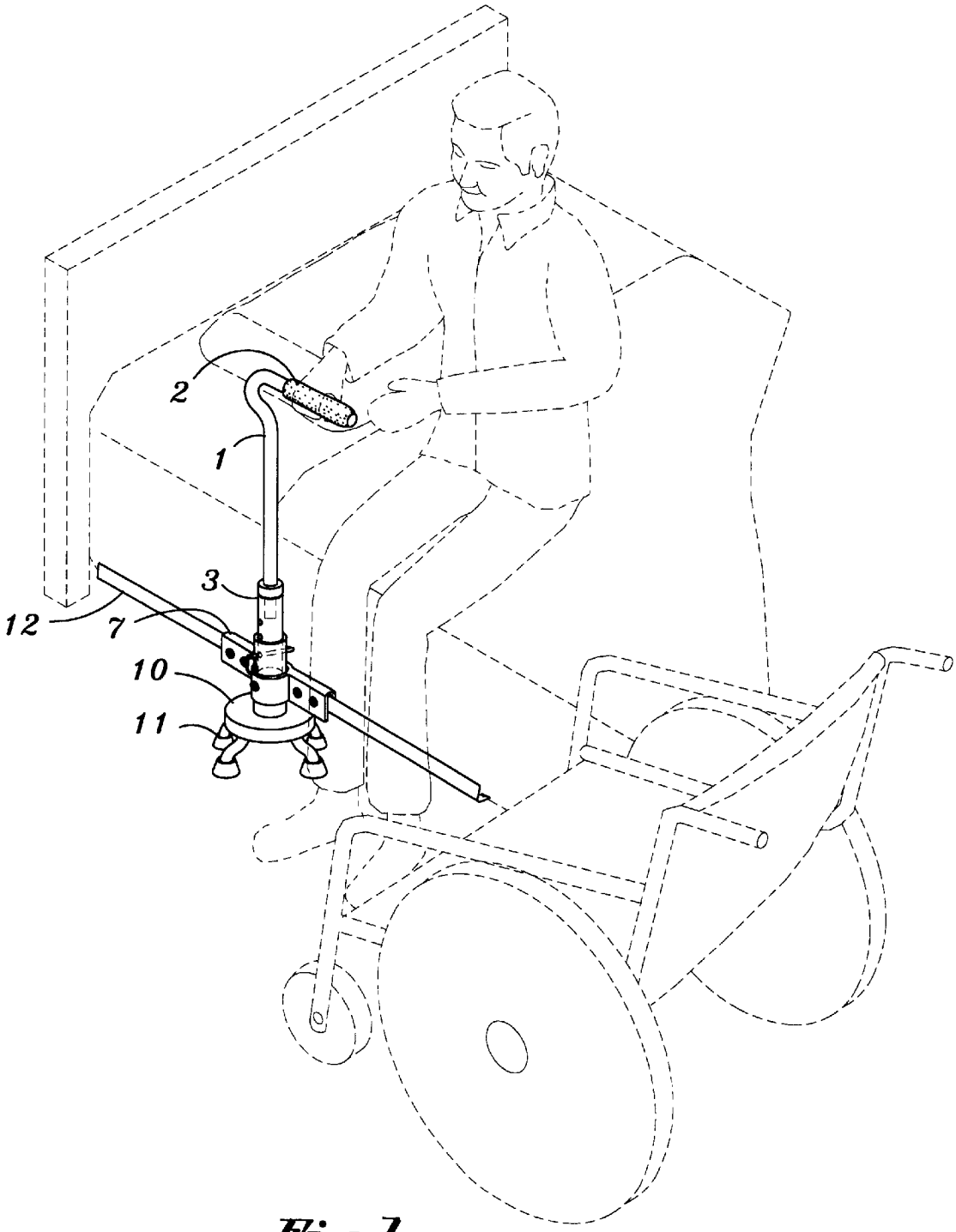
FIG. 1 is a perspective view of the bed to wheel chair assist device in accordance with the present invention attached to the side rail of the bed of a disabled or pain suffering individual.
Figure 2:
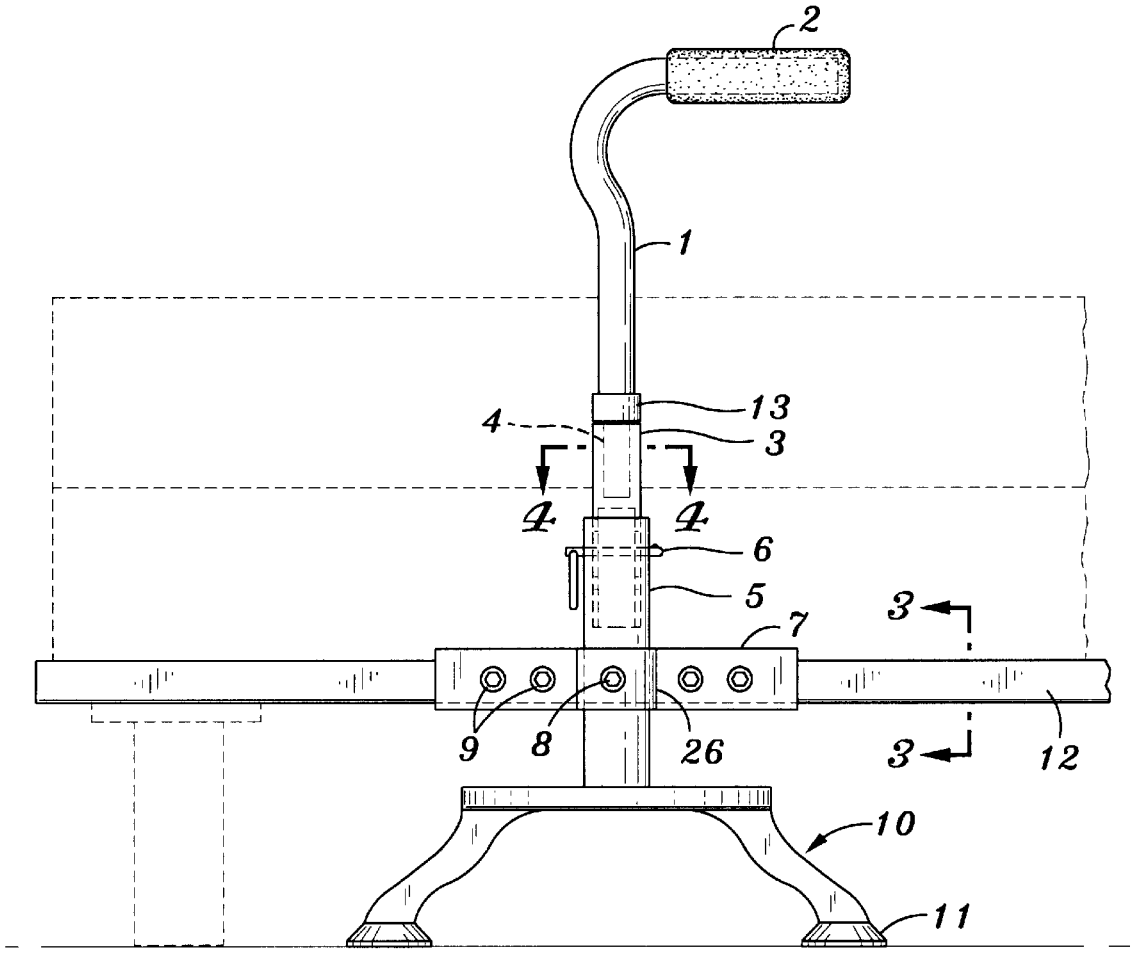
FIG. 2 is a side elevation of the assist device of FIG. 1.
Figure 4:
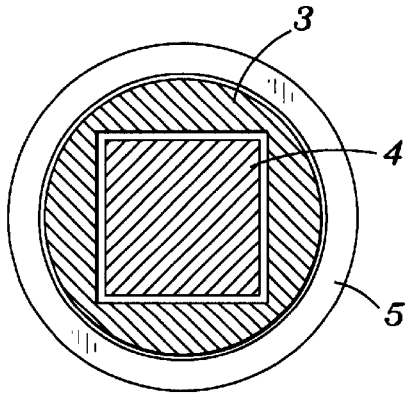
FIG. 4 is an enlarged cross section taken along lines 4—4 of FIG. 2 to show a first embodiment for attaching a handle insert of the assist device to a base receiver.
Figure 5:
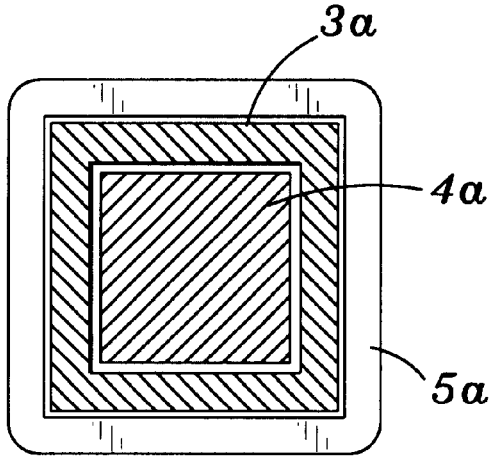
FIG. 5 is an enlarged cross section to show an alternate embodiment for attaching the handle insert to the base receiver.
Figure 6:
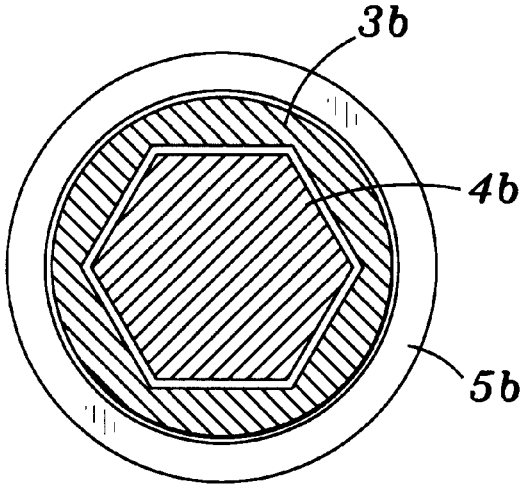
FIG. 6 is an enlarged cross section to show another embodiment for attaching the handle insert to the base receiver.
Figure 7:
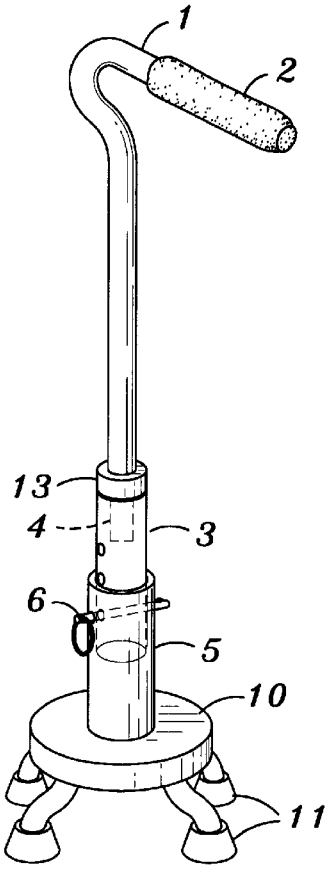
FIG. 7 shows the assist device in the assembled configuration without a bed anchoring clamp.
Figure 8:
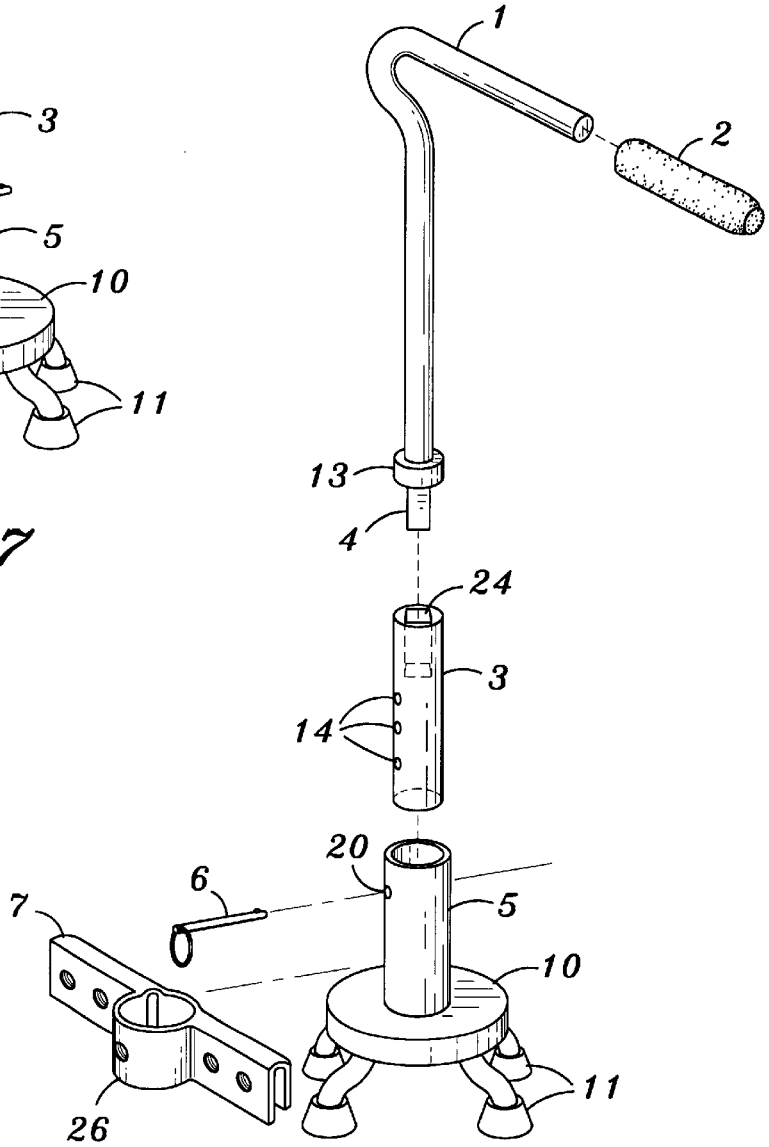
FIG. 8 is an exploded view of the assist device of FIG. 7 including the bed anchoring clamp.

FIGS. 1, 2 and 7 of the drawings show the bed to wheelchair transfer device which forms the present invention. This device includes a light weight (e.g. aluminum or magnesium alloy) swan-necked removable handle 1 having a rubber grip 2 which allows for a reliable grasp by the user. As is best shown in FIG. 8, the bottom of handle 1 is provided with a solid metal insert which fits snuggly into a correspondingly shaped cavity 24 formed in a receiver 3. FIGS. 4–6 of the drawings show alternate embodiments where a square insert 4 at the bottom of the handle 1 is received by a correspondingly shaped insert formed in a cylindrical receiver 3 (FIG. 4) or a square insert 4*a* of handle 1 is received by a correspondingly shaped cavity formed in a rectangular receiver 3*a* (FIG. 5) or a hexagonal insert 4*b* of handle 1 is received by a correspondingly shaped cavity formed in a cylindrical receiver 3*b* (FIG. 6).

As is also best shown in FIG. 8, the receiver 3 fits into a hollow base 5 and is detachably secured therein by a locking pin 6 having the usual pull ring and lock ball at opposite ends thereof. A plurality of vertically spaced cross bores 14 are formed through the receiver 3, and a single cross bore 20 is formed through the hollow base 5. The cross bores 14 and 20 allow for height adjustment of the handle 1 above the floor depending upon the particular bore 14 of receiver 3 that is axially aligned with the bore 20 of base 5 to removably receive locking pin 6. A relatively wide depth limiting and stabilizing collar 13 prevents the handle 1 from dropping too far into the cavity 24 of receiver 3. The base 5 is welded onto a standard quadruped base 10 which allows for a transfer of the torque from the handle 1 to the floor. The quadruped base 10 acts to disperse the torque to the four legs 11 which occupy different areas on the floor in order to stabilize the handle 1. Each leg 11 has a rubber cap which prevents damage to the floor and prevents rotation of the device.

Figure 3:
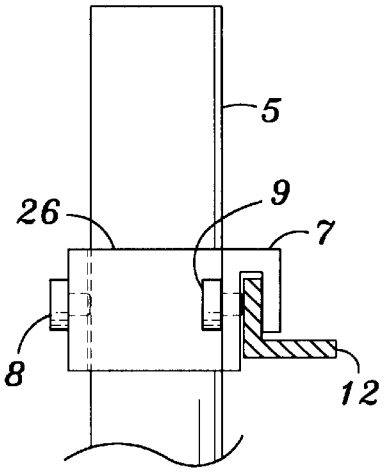
FIG. 3 is an enlarged partial cross section showing the means for securing the assist device to a typical angle iron bed frame.

Turning to FIGS. 2 and 3 of the drawings, the base 5 of the transfer assist device is secured to the existing angle-iron bed frame 12 by means of a clamping member 7 that includes a U-shaped channel which allows for quick and easy mounting (i.e. hooking) over a standard angle-iron bed frame 12. Clamping member 7 also includes a hollow cylindrical body 26 that is sized to surround and slide vertically along the cylindrical base 5, whereby the position of clamping member 7 may be selectively adjusted relative to the position of the bed frame 12. To this end, a set screw 8 is located through the body 26 of clamping member 7 which provides for a secure attachment to base 5. The set screw 8 also prevents the clamping member 7 from accidentally traveling up and down along the base 5. Additional set screws 9 located through the U-shaped channel provide for securing the clamping member 7 to the bed frame 12. The set screws 9 also prevent movement of the clamping member 7 along the bed frame 12.

Figure 9:
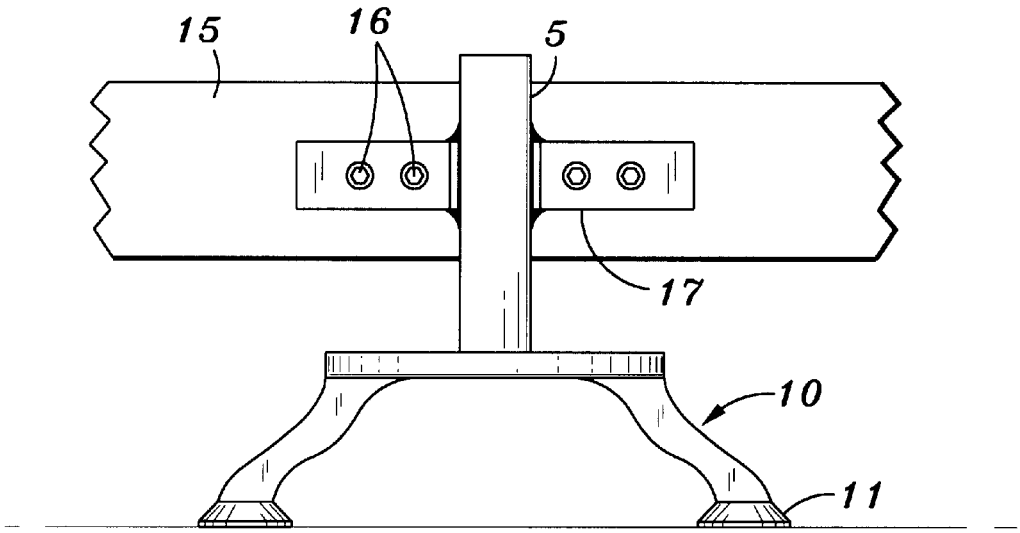
FIG. 9 shows an alternate embodiment for securing the assist device to a wooden bedframe.

FIG. 9 of the drawings shows that base 5 of the transfer assist device can be mounted on a wooden bed frame 15 by means of welding a metal plate 17 to the base 5. Bolts 16 are located through the plate 17 which provide for securing the assist device to the wooden bed frame 15.

Figure 10:
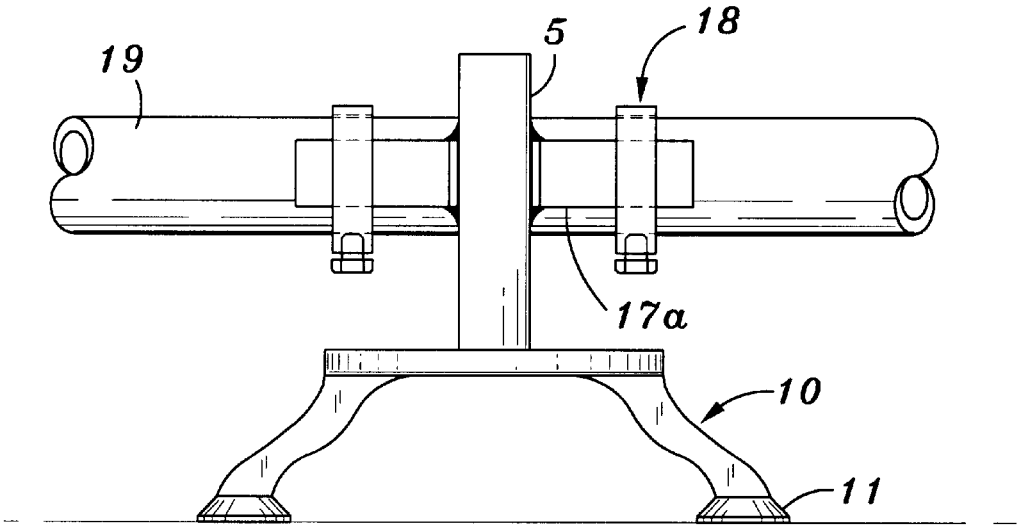
FIG. 10 shows another alternate embodiment for securing the assist device to a bedframe that uses a round iron frame.

FIG. 10 of the drawings shows that base 5 of the transfer assist device can also be mounted on a bed having a round iron frame 19. In this case, a metal plate 17*a* is welded to the base 5, and U-clamps 18 are welded to plate 17*a* for attachment to the rounded bed frame 19.

In operation, when a disabled or infirm or elderly individual wishes to independently move himself from his bed to a wheelchair with no outside assistance other than the transfer device of this invention, he first sits up in his bed and grasps the grip 2 of handle 1. The individual uses the handle 1 to stabilize himself while pushing off the bed and towards the wheelchair. The individual may then push himself onto the seat of the wheelchair. At this point, the individual simply pulls the handle upwardly from and out of the receiver 3. The handle 1 can then be moved to a nearby, but out of sight location (e.g. under a pillow at the top of the bed) so as not to be visible to visitors. Once the individual slides himself from his wheelchair and back to his bed, the handle 1 may be retrieved and returned to the receiver 3. In the meantime however, the handle 1 has been conveniently detached from the transfer assist device so as not to interfere with the ability of the individual to swing his legs off the wheel chair and onto the bed. In this same regard, the transfer assist device herein disclosed also has application for assisting a person who experiences severe back pain when attempting to raise and lower his upper torso between prone and seated positions on the bed.

I claim:

1. A device to assist an individual in lifting his body up from a bed on which the individual is lying or seated, said assist device comprising:

a hollow base to support said assist device against the floor;

a receiver having a cavity formed in a first end thereof, the opposite end of said receiver slidably received within said hollow base;

a removable handle to be grasped by the individual to stabilize himself while lifting up from the bed, said removable handle having an insert projecting from one end thereof to be removably received by the cavity formed in the first end of said receiver, said removable handle surrounded by a depth limiting collar having a cross-section that is larger than the cross-section of the cavity of said receiver within which said insert is removably received, said depth limiting collar limiting the penetration of said insert within said cavity so as to enable the removable handle to be easily removed from the receiver by the individual once he has lifted his body up so that said handle can be moved away from the receiver so as not to interfere with the individual's return to the bed; and attachment means detachably connected to and slidable vertically along said hollow base so that the position of said attachment means can be adjusted relative to the position of the side rail of the frame of the bed of the individual, said attachment means adapted to be mated to the side rail, whereby said assist device is coupled to the bed.

2. The assist device recited in claim 1, wherein the insert projecting from said handle has a rectangular cross-section and the cavity formed in said receiver has a correspondingly rectangular shape to accommodate said insert therewithin.

3. The assist device recited in claim 1, wherein said insert projecting from said handle has a hexagonal cross-section and the cavity formed in said receiver has a correspondingly hexagonal shape to accommodate said insert therewithin.

4. The assist device recited in claim 1, wherein said handle has a swan shaped neck.

5. The assist device recited in claim 1, wherein said attachment means detachably connected to said hollow base includes a U-shaped clamping member that is sized to be hooked over top of the side rail of the frame of the individual's bed.

6. The assist device recited in claim 1, wherein said attachment means detachably connected to said hollow base includes a metal plate and a fastener by which to secure said metal plate to the side rail of the frame of the individual's bed.

7. The assist device recited in claim 1, wherein said attachment means includes a body that is sized to surround and slide vertically along said hollow base.

8. The assist device recited in claim 1, wherein said receiver is slidable within said hollow base, whereby the distance between said removable handle and the floor is selectively adjustable depending upon the position of said receiver within said hollow base.

* * * * *